US005727068A

United States Patent [19]

Karagosian et al.

[11] Patent Number: 5,727,068

[45] Date of Patent: Mar. 10, 1998

68

[54] MATRIX DECODING METHOD AND APPARATUS

[75] Inventors: Michael A. Karagosian, Woodland Hills, Calif.; Robert R. Reams, Lynnwood, Wash.

[73] Assignee: Cinema Group, Ltd., Calabasas, Calif.

[21] Appl. No.: 609,843

[22] Filed: Mar. 1, 1996

[51] Int. Cl.[6] ..... H04R 5/00

[52] U.S. Cl. ..... 381/22; 381/20

[58] Field of Search ..... 381/1, 7–28

[56] References Cited

U.S. PATENT DOCUMENTS 3,632,886 1/1972 Scheiber .
3,746,792 7/1973 Scheiber .
3,825,684 7/1974 Ito et al. .
3,944,735 3/1976 Willcocks .
3,959,590 5/1976 Scheiber .
4,799,260 1/1989 Mandell et al. .
4,941,177 7/1990 Mandell et al. .
5,046,098 9/1991 Mandell et al. .

*Primary Examiner*—Curtis Kuntz
*Assistant Examiner*—Ping W. Lee
*Attorney, Agent, or Firm*—Fenwick & West LLP

[57] ABSTRACT

A matrix decoding system and method generates left, right, center and surround output signals by adding and subtracting weighted versions of first and second input signals. The output signals are generated using a variable matrix to combine the input signals. The variable matrix is controlled by steering control signals derived from a controller which generates the steering control signals responsive to the detected phase difference between the first and second input signals. The decoding system and method uses compressors to generate constant amplitude versions of the input channels prior to performing phase detection. Because the compressors generate constant amplitude signals, phase detection is not affected by an imbalance in channel power.

14 Claims, 3 Drawing Sheets

MATRIX DECODING METHOD AND APPARATUS

BACKGROUND OF THE INVENTION

1. Field of the Invention

This invention relates to a method and system for decoding multiple audio channels and more particularly to a variable matrix decoding method and system.

2. Description of the Related Art

Conventional multi-channel sound systems having left, right, center and surround speakers transmit audio signals over two channels. The signals on each of the channels is encoded such that the channel signals may be decoded to derive directional information in order to create the appropriate signal for each of several speakers placed about a room, theater or the like (conventionally left, right, center and surround speakers). Combining multiple channels to a lesser number of channels is called "matrixing" and is performed by matrix encoders. One conventional matrix format is a 4-2-4 format, where four channels of audio are phase encoded over two channels and then recorded onto, broadcast over or otherwise transmitted over two channels ($L_T$ and $R_T$). Typically, the two channels are received and rebroadcast as either a stereo (two channel) signal or are decoded to generate four audio signals which approximate the four original audio channels.

One conventional encoding scheme widely used in cinema applications uses the 4-2-4 encoding format. This conventional encoding format encodes Left (L), Center (C), Right (R), and Surround (S) signals onto two channels: $L_T$ and $R_T$ in accordance with the following equations:

$$L_T=L+0.707*(C+S)$$

$$R_T=R+0.707*(C-S).$$

Several variable matrix decoding techniques are known in the audio industry. One conventional variable matrix decoding scheme uses a variable matrix decoder which optimizes the directional effect of the four decoded audio signals (L', R', S' and C') through the use of two control signals which are generated using the amplitude of the encoded audio signals $L_T$ and $R_T$. The first control signal is generated by computing the logarithm of the amplitude ratio of the encoded audio signals ($L_T$ and $R_T$). The second control signal is generated by computing the logarithm of the amplitude ratio of the sum and difference of the encoded audio signals ($L_T$ and $R_T$). These computed control signals are then used to control a number of multipliers that independently adjust the levels of the encoded audio signals ($L_T$ and $R_T$) to create multiple audio outputs (L', R', S' and C'). Because this method relies on the amplitude of the encoded audio signals to control a variable matrix, this method is sensitive to channel imbalances as between $L_T$ and $R_T$.

Other conventional multi-channel sound systems also derive decoded audio signals (L', R', S', and C') relying solely on amplitude information or using amplitude information in combination with phase information. Because these conventional sound systems also use amplitude information to varying degrees to derive directional information, such systems are also sensitive to channel imbalances as between $L_T$ and $R_T$ which can lead to decoding error. Thus, it is desirable to have a decoding system and method that is independent of amplitude and that is thus insensitive to level imbalances over a wide frequency range.

Yet other conventional decoders use non-linear techniques to determine phase to derive directional information.

For example, one conventional decoder uses high gain amplifiers (non-linear circuits which harmonically distort the encoded audio signals) to transform the encoded audio signals into rectangular waves. Because the high gain amplifiers are non linear circuits, they cause undesirable harmonic distortion which creates errors with asymmetrical waveforms. The rectangular waves are then used to drive capacitor-based switching circuits for phase detection. Because the phase detection under this conventional scheme relies on the changing characteristics of a capacitor, the detected phase difference is dependent not only on the relative phase of the encoded audio signals, but is also dependent on the frequencies of the audio signals.

Additionally, these conventional decoders are designed for an efficient analog implementation and require complex digital implementations. Therefore, there is a need for a multi-channel decoding system and method that decodes directional information without being affected by input signal imbalances, which uses linear phase detection techniques and which has an efficient digital as well as analog realization.

SUMMARY OF THE INVENTION

In accordance with the present invention, there is provided a matrix decoding apparatus and method for decoding directional information in a multi-channel system. Four directional audio channels (left, right, center and surround) are encoded on two audio channels using a conventional 4-2 encoding scheme. The matrix decoder of the present invention recovers directional information by detecting and decoding the relative phase shift between two encoded audio input channels. Based on the recovered directional information, the decoder operates in any of three extreme modes: surround-dominant mode, center-dominant mode or left-right mode, or in a mode between the extreme modes.

In surround-dominant mode, the originally encoded surround channel is emphasized on the surround output channel. In the center-dominant mode, the originally encoded center channel is emphasized on the center output channel and in left-right dominant mode, the originally encoded left and right input channels are emphasized on the left and right output channels.

The matrix decoding system of the present invention uses a phase detecting controller to generate steering control voltages in proportion to the phase difference between the two encoded audio input channels. The steering control voltages control a variable matrix to generate a desired audio effect by emphasizing various components (L, R, C or S) of the matrix output signals.

Before coupling the encoded audio input channels to the phase detector, the audio input channels are first each processed by a compressor (an amplitude normalizer) which amplitude normalizes each of the encoded input channels. The outputs of each compressor have a substantially constant amplitude, but retain the phase and frequency information for each respective channel. Preferably, each compressor includes an attenuator controlled by a peak detector (or other signal value detector) coupled to a threshold detector. Thus, the attenuator is adjusted to maintain signal gain near a selected threshold.

The amplitude normalized outputs of the compressor are coupled to a phase detecting controller. The controller includes a multiplier which generates at its output an AC signal having a DC offset which corresponds to the detected relative phase of the normalized signals received from each of the compressors.

The multiplier output is coupled to a phase decoder that generates first and second steering control signals to control (steer) a variable matrix in response to the detected phase difference. For example, the variable matrix is steered to operate in any of the surround-dominant mode, center-dominant mode or left-right mode, or a combination of any of these modes (i.e., a mode in between any of the extreme modes).

The variable matrix performs a weighted summation of the two encoded audio signals to generate each of four audio outputs (Left, Right, Center and Surround). The variable matrix includes a bank of expanders having outputs coupled to a bank of signal combiners. Each signal combiner has a plurality of inputs coupled to a combination of selected audio inputs and expander outputs. Each signal combiner additionally has weighting factors associated with a plurality of inputs for scaling the corresponding input prior to summation. Thus, each signal combiner generates an output signal by generating a weighted summation of selected inputs. The operation of the matrix is varied by selectively attenuating the inputs to the signal combiners using the bank of expanders. Steering control signals generated by the controller control the expanders to attenuate the encoded input audio channels responsive to the steering control signals. Thus, the expanders are used to vary the matrix weighting coefficients in response to the first and second steering control signals. By varying the attenuation of each expander from no attenuation to maximum attenuation the variable matrix is placed in a desired operating mode.

DESCRIPTION OF THE PREFERRED EMBODIMENT

Figure 1:
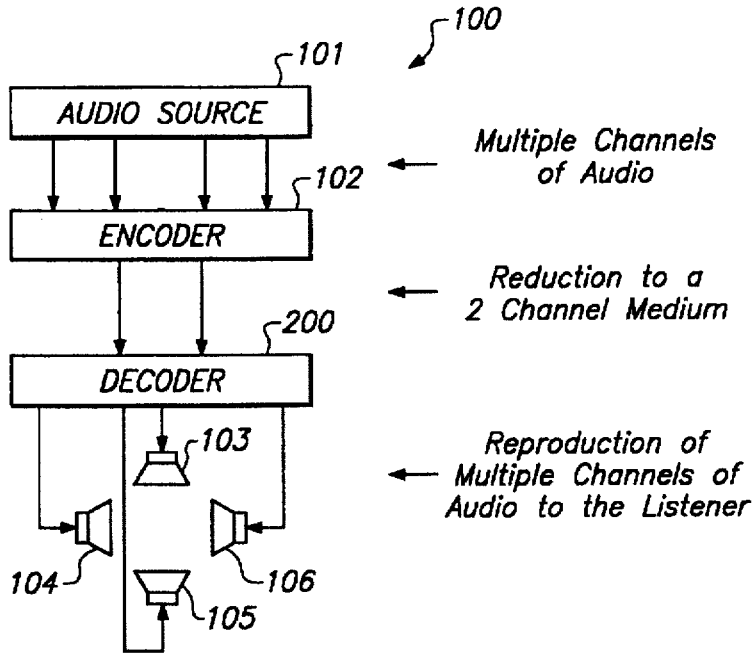
FIG. 1 illustrates an encoding and decoding system having a decoder in accordance with the present invention.

Referring now to FIG. 1, there is illustrated a matrix encoding and decoding system 100 using a decoder 200 in accordance with the present invention. System 100 has an audio source 101 having four output terminals coupled to encoder 102. Audio source 101 generates four audio channels, Left (L), Right (R), Center (C) and Surround (S), one on each output terminal. The four audio channels are directional channels in that they correspond to left, right, center and surround sound sources respectively. Encoder 102 is a 4-2 encoder having four input terminals coupled to the output terminals of audio source 101. Encoder 102 also has two output terminals for transmitting encoded audio signals ($L_T$ and $R_T$), which are encoded versions of the four signals (L, R, C and S) received on the encoder 102 input terminals. Encoder 102 preferably encodes the four channels to produce two encoded audio signals ($L_T$ and $R_T$) in accordance with the following equations:

$$L_T=L+0.707*(C+S) \quad \text{(equation 1)}$$

$$R_T=R+0.707*(C-S) \quad \text{(equation 2)}$$

where 0.707 denotes one half the square root of two. The output terminals of encoder 102 are coupled to two input terminals 201*a*, 201*b* (shown in FIG. 2) of decoder 200. In accordance with the present invention, decoder 200 is a 2–4 decoder which recovers on its four output terminals 207*a*–207*d* (shown in FIG. 2) four audio signals, L', R', C' and S'. Each audio signal, L', R', C' and S' approximates the corresponding signal on input audio channels, L, R, C and S originally received at the input terminals of encoder 102. Each of the recovered signals (L', R', C' and S') are coupled through an amplifier (not shown) to a speaker 103–106, preferably situated about a room in a left, right, center or surround position.

Decoder 200 advantageously decodes the encoded audio signals ($L_T$ and $R_T$) by amplitude normalizing the audio signals and by then generating matrix steering control signals responsive to the relative phase difference of the normalized signals. The steering control signals are coupled to a variable matrix and adjust the weights (multiplier coefficients) used by the variable matrix.

Figure 2:
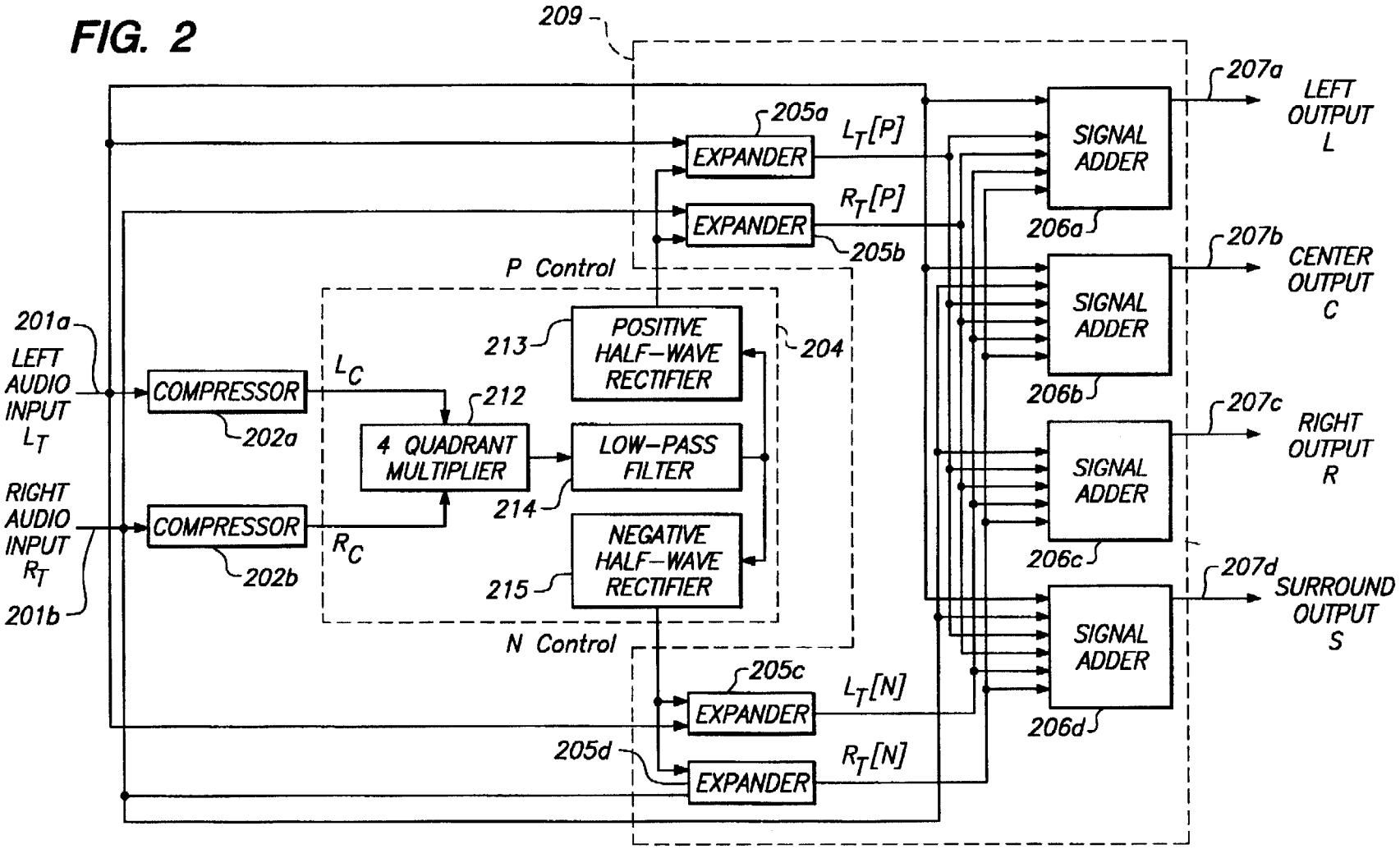
FIG. 2 is a functional block diagram of a decoder in accordance with the present invention.

FIG. 2 is a block diagram of a matrix decoder 200 in accordance with the present invention. Matrix decoder 200 has two input terminals 201*a*, 201*b*, four output terminals 207*a*–207*d*, compressors (amplitude normalizers) 202*a*, 202*b*, a controller 204 and a variable matrix 209. Controller 204 is a phase detector and decoder which generates steering control signals for variable matrix 209. Variable matrix 209 includes center expanders 205*a* and 205*b*, surround expanders 205*c* and 205*d* and signal combiners 206*a*–*d* with outputs coupled to output terminals 207*a*–207*d*. Input terminals 201*a*, 201*b* are each adapted to receive the left ($L_T$) and right ($R_T$) input signals (encoded audio signals) from left and right transmission channels respectively. Compressors 202*a*, 202*b* are coupled to input terminals 201*a* and 201*b*, respectively and each generate an amplitude normalized (constant amplitude) version of the respective input signal. The outputs of compressors 202*a*, 202*b* are coupled to controller 204.

Controller 204 includes a multiplier 212, a low pass filter 214 coupled to the multiplier 212 output and half wave rectifiers 213, 215 coupled to the outputs of low pass filter 214. Multiplier 212 generates an output signal (an AC signal) having an offset (a DC offset) corresponding to the relative phase difference of the encoded audio inputs received on input terminals 201*a* and 201*b*. Controller 204 recovers phase information using the AC signal generated by multiplier 212 and generates matrix control signals (steering control signals) responsive to the detected phase difference.

Variable matrix 209 includes signal combiners 206*a*–*d* and expanders 205*a*–*d* which are controlled by the steering control signals received from controller 204. Specifically, controller 204 decodes the output of multiplier 212 to generate a center steering signal (the P control signal) coupled to center expanders 205*a* and 205*b* and a surround steering signal (the N control signal) coupled to surround expanders 205*c* and 205*d*. In addition to receiving steering signals, center expanders 205*a* and 205*b* each are coupled to an input terminal 201*a* or 201*b* for receiving the left ($L_T$) and right ($R_T$) input channels respectively. Similarly, surround expanders 205*c* and 205*d* are each coupled to an input terminal 201*a* or 201*b* for receiving left and right input channels respectively. Expanders 205*a*–*d* are active attenuators that attenuate the left ($L_T$) or right ($R_T$) input channels in accordance with the surround and center control (steering) signals generated by controller 204.

Variable matrix 209 additionally has four signal combiners 206*a–d* each coupled to the output of each expander 205*a*–205*d*. Signal combiners 206*a–d* are multiply-add circuits for multiplying a plurality of inputs by a pre-selected weighting factor and then for summing the weighted inputs. In additional to being coupled to expanders 205*a–d*, signal combiner 206*a* is also coupled to input terminal 201*a* for receiving the left encoded audio channel ($L_T$) without any attenuation. Similarly, in addition to being coupled to expanders 205*a–d*, signal combiners 206*b* and 206*d* are each also coupled to input terminals 201*a* and 201*b* for receiving the left ($L_T$) and right ($R_T$) input channels without any attenuation. Finally, in addition to being coupled to expanders 205*a–d*, signal combiner 206*c* is also coupled to input terminal 201*b* for receiving the right encoded audio channel ($R_T$) without attenuation.

In accordance with the illustrated embodiment, the decoder 200 has three base modes of operation: surround-dominant mode, center-dominant mode and left-right mode. Controller 204 steers the operating mode of decoder 200 using N and P control signals. When the P control signal is at or near its maximum positive value and the N control signal is at or near zero, then decoder 200 operates in surround-dominant mode. When the P control signal is at or near zero and the N control signal is at or near its maximum negative value, then decoder 200 operates in center-dominant mode. When both the P and N control signals have values at or near zero, then decoder 200 operates in left-right mode. Thus, decoder 200 operates in (i) surround-dominant mode when controller 204 determines that the input audio signals have a maximum positive correlation (i.e., the signals are in phase), (ii) in center-dominant mode when controller 204 determines that the input audio signals have a maximum negative correlation (i.e., the signals are out of phase) and in (iii) left-right mode when the audio input channels are uncorrelated or have a relative phase shift of 90°.

Decoder 200 additionally operates in combination modes which combine any of the three base modes to varying degrees when controller 204 determines either a positive or negative correlation but which is not maximum. In this case, both the P and N control signals have a non zero voltage but are not at their maximum or minimum values. For example, if controller 204 determines that the encoded input channels are positively correlated, but not to a maximum extent, then the decoder 200 will operate in a combined surround-dominant and left-right mode.

The decoder 200 of the present invention generates a facsimile of the encoded L, R, C, and S channels on each output terminal 207*a*–207*d* (output channels L', R', C', and S', respectively). Each output signal is a weighted summation of the left and right input channels ($L_T$ and $R_T$) as received from input terminals 201*a*, 201*b* and selectively attenuated versions of the left and right input channels ($L_T$ and $R_T$) received from expanders 205*a–d*. The weights used by each signal combiner 206*a–d* are selected to optimize decoder performance in each of the surround-dominant, center-dominant and left-right operating modes. Selection of the weights for each of the signal combiners 206*a–d* is discussed below.

Referring now to compressors 202*a*, 202*b* shown in FIG. 2, compressors 202*a*, 202*b* are each preferably coupled to respective input terminals 201*a*, 201*b* via high pass filters (not shown). Compressors 202*a*, 202*b* normalize the amplitude of the encoded audio signals on the $L_T$ and $R_T$ input channels. The resulting output is a normalized (constant amplitude) version of the respective signals $L_T$ and $R_T$. Preferably, compressors 202*a*, 202*b* introduce a minimum signal distortion. The normalized outputs of compressors 202*a*, 202*b* are coupled to controller 204. By normalizing the amplitude of the $L_T$ and $R_T$ signals, the controller 204 is not affected by amplitude variations in the encoded input signals $L_T$ and $R_T$.

Figure 3:
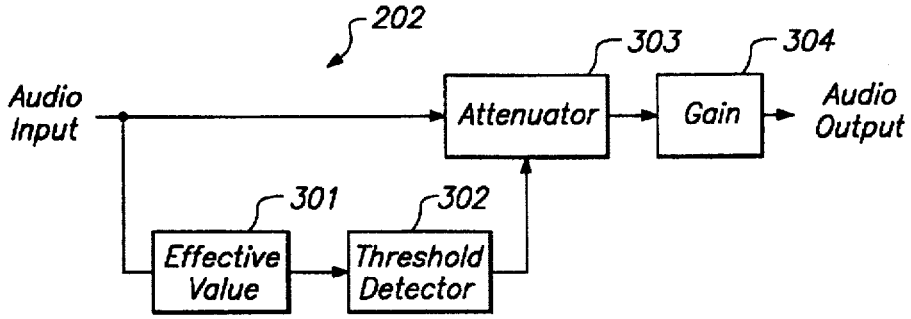
FIG. 3 is a functional block diagram of a compressor (amplitude normalizer) in accordance with the present invention.

There is illustrated in FIG. 3 a block diagram of one implementation of compressors 202*a*, 202*b*. Compressors 202*a*, 202*b* detect the "effective value" of the input audio signal. As used herein, "effective value" means the absolute value of the signal strength. Signal strength may be determined using any one of a number methods. For example, one method computes the root mean squared (RMS) value of the signal by computing the root of the sum of the squared amplitude values above and below 0 volts within a given time window. Another method of computing the effective value of the signal performs full wave rectification and then averages the signal using a frequency dependent network such as an RC (resistor-capacitor) network. Another method is a peak detection method which is based on the instantaneous absolute values of the signal peaks. Using this method, each peak value is held until another valid peak is identified. Peak detection advantageously allows an amplitude normalizer to react quickly to changes in signal strength.

Referring now again to FIG. 3, the effective value of the input audio signal is preferably detected using a peak detector 301, which produces a value representing the peak waveform voltage. Peak detector 301 is coupled to threshold detector 302 such that the transfer function of the threshold detector 302 is unity at or above a selected threshold level. In the illustrated embodiment, the selected threshold is low, preferably in the range of −30 to −50 dB. The threshold selection affects the range over which decoder 200 will effectively determine the presence of center and surround material. As threshold detector 302 detects an increased effective value of the signal, exemplary compressor 202 increases the attenuation of attenuator 303. Thus, when threshold detector 302 detects an effective value at or above the selected threshold, attenuator 303 attenuates the audio input signal. However, when the effective value is below the selected threshold, no attenuation is performed by attenuator 303. Therefore, attenuator 303 maintains the gain of the encoded audio input signal (either $L_T$ or $R_T$) at or near the selected threshold level. Compressor 202 also includes a gain stage 304 which is coupled to attenuator 303 to amplify the attenuated signal to a desired level. Gain stage 304, however, is an optional component of compressor 202. The amount of gain selected for gain stage 304 is dependent upon the gains and settings of the components found elsewhere in decoder 200, such as the gain of the half-wave rectifiers 213, 215, the gain of low pass filter 214, and the thresholds chosen for the expanders 205*a–d*. Although the preferred detection method of the compressor 202 is peak detection as illustrated, other effective value detection methods may be used such as fast averaging or root mean squared (RMS) detection.

Referring now again to FIG. 2, controller 204 receives the normalized (constant amplitude) left and right input channels ($L_T$ and $R_T$) from the outputs of compressor 202*a* and 202*b*. Controller 204 preferably includes a four quadrant multiplier 212 which generates an AC output having a DC component proportional to the relative phase of the incoming $L_T$ and $R_T$ encoded audio signals. Again, because the $L_T$ and $R_T$ input signals are normalized prior to multiplication, the multiplier 212 output, and hence the generation of the steering control signals, is not affected by imbalances in the input signals ($L_T$ and $R_T$).

The compressors 202a and 202b of the present invention preferably normalize a signal over a wide dynamic range. Normalization over a wide dynamic range provides the benefit that the decoder will operate over a wide dynamic range of input signals. Thus, the decoder 200 of the present invention advantageously steers input signals having relatively low level center and surround signals. This ability to steer low level signals is particularly advantageous in cases where low level voice is recorded on the center channel which at the same time, comparatively loud (high signal strength) special effects or music is recorded on the left and right channels.

Multiplier 212 generates an AC signal having an offset (a DC offset) and having separately identifiable components of frequency and relative phase information. The phase information is contained in the offset. The offset is proportional to the relative phase of $L_T$ and $R_T$. When $L_T$ and $R_T$ correlate as in phase signals, the output of multiplier 212 is offset such that all values of the AC output signal are positive. When $L_T$ and $R_T$ have a correlation indicating that $L_T$ and $R_T$ are out-of-phase, the output of multiplier 212 is offset such that all values of the AC output signal are negative. The offset of the AC signal will vary proportionally to any value in-between according to the relative phase of $L_T$ and $R_T$. Uncorrelated signals will not produce an offset at the output of multiplier 212.

Figure 4:
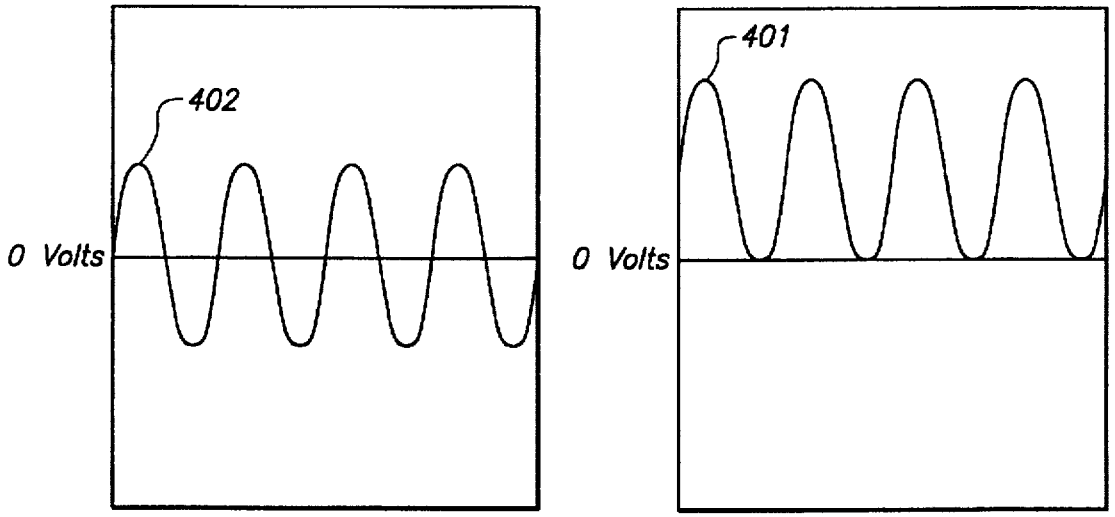
FIG. 4 illustrates multiplier outputs in accordance with the present invention.

FIG. 4 illustrates the output of multiplier 212 when multiplying correlated signals. Waveform 401 illustrates the output of multiplier 212 when two sinusoids of half the frequency shown and having a relative phase shift of 0 degrees are applied to the inputs of multiplier 212. Waveform 402 illustrates the output of multiplier 212 when two sinusoids having a relative phase shift of 90 degrees are applied to the inputs of multiplier 212. Waveform 401, corresponding to 0 degree phase shift input signals, has a large positive offset and waveform 402, corresponding to a 90 degree phase shift has no offset. These waveforms illustrate multiplier 212 outputs for correlated signals $L_T$ and $R_T$. When encoded audio inputs $L_T$ and $R_T$ are uncorrelated signals, however, multiplier 212 generates an output with an offset of 0 volts as with the 90 degree example.

The operation of multiplier 212 is further described by reference to the following equations. First, considering the case where the input terminals 201a, 201b receive correlated signals $L_T$ and $R_T$, $L_T$ and $R_T$ can be represented as:

$$L_T=a_L\cdot\sin(\omega\tau) \quad \text{(equation 1)}$$

$$R_T=a_R\cdot\sin(\omega\tau-\psi) \quad \text{(equation 2)}$$

where $\omega\tau$ represents the phase angle of the time-varying input signal; and where $\psi$ represents the relative phase shift to the left channel.

After amplitude normalization by compressors 202a and 202b, the amplitude information is removed from $L_T$ and $R_T$, leading to the expressions:

$$L_c=k\cdot\sin(\omega\tau) \text{ and} \quad \text{equation 3a}$$

$$R_c=k\cdot\sin(\omega\tau-\psi) \quad \text{equation 3b}$$

The product of these equations, as generated by multiplier 212 is:

$$L_c=R_c=k'[\cos(\psi)-\cos(2\omega\tau-\psi)] \quad \text{equation 4}$$

where $k'=k^2/2$ is a constant.

In equation 4, the $\cos(\psi)$ term represents the offset of file multiplier 212 output, and is solely dependent upon the relative phase $\psi$ of the input signals ($L_T$ and $R_T$). The $\cos(\omega\tau-\psi)$ term represents the frequency-dependent component of the product. This component has a frequency twice that of the input signal. Because compressors 202a, 202b normalize input signals $L_T$ and $R_T$, the frequency-dependent component also has a fixed amplitude. In accordance with the present invention, the phase term generated by phase detector 203 is decoded by controller 204 to generate matrix steering signals as discussed below.

Next, considering the case where input terminals 201a, 201b receive uncorrelated signals $L_c$ and $R_c$. $L_c$ and $R_c$ can be expressed as:

$$L_c=k\cdot\sin(\omega_1 t) \quad \text{(equation 5)}$$

$$R_c=k\cdot\sin(\omega_2 t) \quad \text{(equation 6)}$$

After multiplication by multiplier 212, the product is expressed as:

$$\begin{aligned} L_c\cdot R_c &= k\cdot\sin(\omega_1 t)\cdot\sin(\omega_2 t) \quad \text{(equation 7)} \\ &= 1/2\cos(\omega_1 t-\omega_2 t)-1/2\cos(\omega_1 t+\omega_2 t) \end{aligned}$$

Thus, when input terminals 201a, 201b are coupled to uncorrelated signals ($L_T$ and $R_T$), the output of multiplier 212 ($L_c\cdot R_c$) contains only the sum and difference frequencies of the uncorrelated signals and has no voltage offset. Thus, only signals having a correlation are capable of generating an offset voltage at the output of multiplier 212. Therefore, multiplier 212 generates an output having an offset proportional to the degree of correlation of the signals coupled to input terminals 201a and 201b.

Controller 204 uses the multiplier 212 output to generate steering control signals (P control and N control) which control variable matrix 209. Controller 204 includes a low pass filter 214 coupled to multiplier 212, positive half wave rectifier 213 and negative half wave rectifier 215. The N control signal is generated by the negative half wave rectifier 215 and indicates a relative phase difference between $L_T$ and $R_T$ in the range of 90° and 270°. The P control signal is generated by the positive half wave rectifier 213 and indicates a relative phase between $L_T$ and $R_T$ in the ranges of 0° to 90° or 270° to 360°.

Figure 5A:
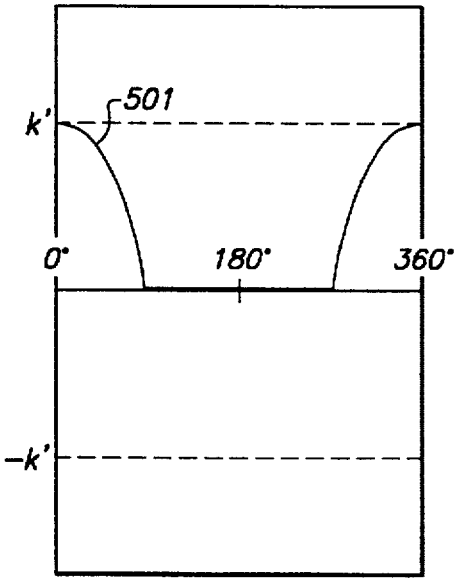
FIG. 5A illustrates a P control signal in accordance with the present invention.
Figure 5B:
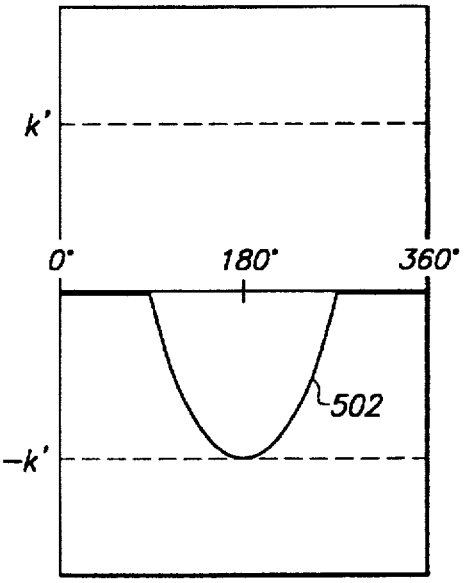
FIG. 5B illustrates an N control signal in accordance with the present invention.

Controller 204 separates the phase and frequency information generated by multiplier 212. Controller 204 preferably first low pass filters the output of multiplier 212 using low pass filter 214. The output of low pass filter 214 is coupled to positive half wave rectifier 213 and to negative half wave rectifier 215. FIGS. 5A and 5B illustrate the P control signal 501 and N control signal 502 respectively, as each vary with the detected phase difference between $L_T$ and $R_T$. As shown in FIG. 5A, the P control signal varies from k down to 0 as the detected $L_T$, $R_T$ phase difference ranges from 0° to 90°. The P control signal has a 0 value for detected phase differences ranging from 90° to 270°. For phase differences from 270° to 360°, the P control signal 501 varies from 0 to k'. The N control signal 502 has a value of 0 for detected phase difference between 0 and 90° or between 270° and 360°. When the detected phase difference is between 90° and 270° the N control signal is between 0 and −k'.

Because the control signals generated by controller 204 (P control and N control) are derived from relative phase information, independent of amplitude variations, the control signals P control and N control can reliably steer variable matrix 209 and provide a stable sound field to the listener.

The outputs of controller 204 are coupled to expanders 205a–d. Expanders 205a–d are downward expanders which are used to control the gain of the "steered" audio signals (encoded signals $L_T$ and $R_T$). When expanders 205*a–d* are fully activated they perform no attenuation on their respective input signals. Thus, when expanders 205*a, b* are fully activated by a maximum valued P control signal (maximum value of k') the output of the respective expander is the encoded input signal (either $L_T$ and $R_T$) with a unity gain. Similarly, when expanders 205*c, d* are fully activated by a minimum valued N control signal (minimum value of −k'), the output of the respective expander is the encoded input signal (either $L_T$ and $R_T$) with a unity gain. When any of the expanders 205*a–d* are less than fully activated then their respective outputs are attenuated versions of $L_T$ and $R_T$. When the control voltage supplied by the N and P control signals is below the threshold of expanders 205*a–d*, the expander output is sharply attenuated. However, when the applied control voltage is above the threshold and below the maximum activation level, expanders 205*a–d* provide variable attenuation, making expanders 205*a–d* operate as more than a mere gating device.

Figure 6:
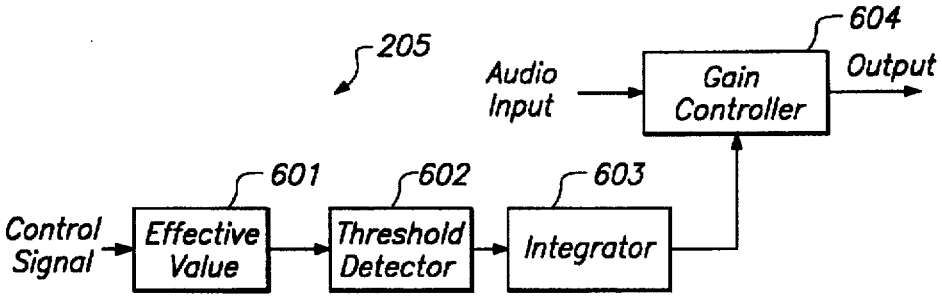
FIG. 6 is functional block diagram of an expander in accordance with the present invention.

FIG. 6 illustrates a block diagram of an exemplary expander 205 in accordance with the present invention. Expander 205 includes a value detector 601, a threshold detector 602 and an integrator 603 all serially coupled to generate a control signal for a gain controller 604.

Expander 205 detects the effective value of the applied control signal using a value detector 601. Value detector 601 is coupled to an associated control signal (either N control or P control) and detects a voltage value of the associated control signal. Preferably value detector 601 performs detection using an averaging circuit or a root mean squared (RMS) detector to reduce the effects of spurious signals. The output of value detector 601 is coupled to a threshold detector 602. Threshold detector 602 is used to adjust the gain of expander 205 towards full attenuation as the detected value of the received control signal moves below a preselected threshold. Conversely, threshold detector 602 adjusts the gain of the expander toward unity gain as the effective value moves above the selected threshold.

Integrator 603 is coupled to threshold detector 602. Integrator 603 adjusts the "attack" and "decay" of expander 205. In one embodiment, it is preferable to achieve unity gain quickly as the detected value of the received control signal moves above the threshold. Therefore, the "attack" time of expander 205 is fast, meaning that integrator 603 has a short time constant for positive-going values of the received control signal. However, it is also preferable to have long "decay" time to prevent audible gating of the audio signal. Therefore, in the preferred embodiment, integrator 603 has a long time constant for negative-going values of control signal.

Integrator 603 is coupled to gain controller 604 and controls the attenuation of gain controller 604. In one embodiment, gain controller 604 is a two-quadrant multiplier. Thus, as illustrated, the maximum gain for a downward expander 205 is 0 dB (unity gain), and the minimum gain is full attenuation.

Referring now again to FIG. 2, pairs of downward expanders (205*a* paired with 205*c* and 205*b* paired with 205*d*) operate on each of the $L_T$ and $R_T$ respectively. One expander of each pair is controlled by the P control signal. The other expander of each pair is controlled by the N control signal. Thus expanders 205*a–d* generate two gain controlled $L_T$ signals and two gain-controlled $R_T$ signals. $L_T(P)$, $R_T(P)$, $L_T(N)$, and $R_T(N)$ used herein denote the signal generated by expanders 205*a–d* respectively. Audio signal $L_T(P)$ is a unity gain version of $L_T$ when a relative phase shift near 0 degrees is detected by phase detector 203, and $L_T(N)$ is a unity gain version of $L_T$ relative phase shift near 180 degrees is detected by controller 204. Audio signal $R_T(P)$ is a unity gain version of $R_T$ when a relative gain when a relative phase shift near 0 degrees is detected, and $R_T(N)$ is a unity gain version of $R_T$ when a relative phase shift near 180 degrees is detected. The signals $L_T$, $R_T$, $L_T(P)$, $L_T(N)$, $R_T(P)$, and $R_T(N)$ are separately weighted and summed to generate the output signals L', R', C', and S'.

As previously described, the P and N control signals contain half-wave rectified and filtered frequency independent components of the multiplier 212 output. The expanders 205*a–d* operate on the effective value of these signals as generated by value detector 301. Because the control signals (N control and P control) are linear representations of the true relative phase angle between $L_T$ and $R_T$, the thresholds of expanders 205*a–d* are set to change the state of variable matrix 209 at a specific relative phase angle.

DERIVATION OF MATRIX COEFFICIENTS AND OPERATION OF THE DECODER

To understand the steering mechanism of decoder 200, it is preferable to review the encoded signals $L_T$ and $R_T$:

$$L_T=L+0.707*(C+S)$$

$$R_T=R+0.707*(C+S).$$

Decoder 200 generates four output audio signals L', R', S' and C' using $L_T$ and $R_T$. Any output the signal can be written in terms of the weighting factors "a" for $L_T$ and "b" and $R_T$ as follows:

$$\begin{aligned} \text{Output} &= (a*L_T)+(b*R_T) \qquad \text{(equation 8)} \\ &= (a*L)+(0.707*a*C)+ \\ &\quad (0.707*a*S)+(b*R)+(0.707*b*C)- \\ &\quad (0.707*b*S). \\ &= [L*a]+[R*b]+ \\ &\quad [C*0.707*(a+b)]+[S*0.707*(a-b)]. \end{aligned}$$

Thus, any of the outputs L', R', S' and C' may be efficiently described by specifying the coefficients "a" and "b" for the respective output channel. The "a" and "b" coefficients for each output channel (L', R', S' and C') are collectively referred to as the matrix coefficients and correspond to the adder weights (used by signal combiners 206*a–d* described below).

Based on empirical system testing, a preferred "optimal" output equation is selected for each extreme variable matrix operating mode (i.e., center-dominant mode, surround-dominant mode and left-right mode)

The preferred output channel (L') equation when the left component (L) is dominant is derived by setting coefficient "a" equal to 1 and coefficient "b" equal to 0. Thus:

For $a=1$ and $b=0$, $$L'=L+(0.707*C)+(0.707*S)=L_T \qquad \text{(equation 9)}$$

The preferred output channel (R') equation when the right component (R) is dominant is derived by setting coefficient "a" equal to 1 and coefficient "b" equal to 0. Thus:

For $a=0$and $b=1$, $$R'=R+(0.707*C)-(0.707*S)=R_T \qquad \text{(equation 10)}$$

The preferred output channel (C') equation when the center component (C) is dominant is derived by setting coefficients "a" and "b" equal to 0.707. Thus:

For $a$=0.707 and $b$=0.707, $$C'=(0.707*L)+(0.707*R)+C \quad \text{(equation 11)}$$

The preferred output channel (S') equation when the surround component (S) is dominant is derived by setting coefficient "a" equal to 0.707 and coefficient "b" equal to −0.707. Thus:

For $a$=0.707 and $b$=−0.707, $$S'=(0.707*L)-(0.707*R)+S \quad \text{(equation 12)}$$

It should be noted that as used herein, 0.707 is the abbreviation for ½ the square root of 2 and 1.414 is the abbreviation for the square root of 2.

Referring to equation 9, the encoded signal L is emphasized 3 dB above C and S, while R is not present. Referring to equation 10, the encoded signal R is emphasized 3 dB above C and S, while L is not present. Referring to equation 11, the encoded signal C is emphasized 3 dB above L and R, while S is not present. Referring to equation 12, the encoded signal S is emphasized 3 dB above L and R, while C is not present. These equations represent the preferred steering conditions to emphasize a signal component (L, R, S and C). In accordance with the equations, only one signal component can be eliminated at any one time on any one output (L', R', S' and C'). Additionally, at most, a 3 dB accentuation will exist between a selected component and the other components.

When varying the matrix, it is desirable to maintain a sound field that contains a constant acoustic power for each component of the signal. Since the power of the signal is proportional to the square of its voltage coefficient, the coefficients for each state of the matrix are chosen such that the sum of the squares of the coefficients for each component always equals a constant. Also, in the illustrated embodiment, it is preferred to maintain the balance of L' and R' and thus no left-right steering is implemented.

CENTER-DOMINANT OPERATING MODE

The following describes the selection of the weighting coefficients for signal combiners 206*a–d* for generating outputs (L', R', S' and C') when decoder 200 is operating in the center-dominant mode (i.e. when decoder 200 has determined by phase detection that the center output channel is the dominant channel).

The center-dominant mode weighting coefficients are selected in accordance with the following criteria:

(1) each of the originally encoded input channels (L, R, S, and C) are to have equal power over the collective outputs (L', R', S' and C') when C' is dominant.

(2) the dominant output channel, C'is selected to have a 3 dB gain for the C component as compared to the other components; and (3) preferably, the weighting of the encoded components should be equal for each output with the exception of the dominant channel's output.

In accordance with the above-stated criteria the following values are preferably selected for coefficients "a" and "b":

TABLE 1

| | a | b |
|---|---|---|
| L' | 0.577 | −0.577 |
| R' | −0.577 | 0.577 |
| C' | 1.000 | 1.000 |
| S' | 0.577 | −0.577 |

Selection of the above values for coefficients "a" and "b" results in the following set of equations for each output channel when decoder 200 is in the center-dominant operating mode:

$$L'=0.577*L-0.577*R+0.000*C+0.816*S$$
$$R'=-0.577*L+0.577*R+0.000*C-0.816*S$$
$$C'=1.000*L+1.000*R+1.414*C+0.000*S$$
$$S'=0.577*L-0.577*R+0.000*C+0.816*S.$$

The above equations satisfy the selected criteria. For example, the equal power criteria is satisfied as it can be shown that the sum of the squares of each column value equals two. The sum of the squares equals two because a 3 dB boost of the dominant output channel (C') was selected.

SURROUND-DOMINANT OPERATING MODE

The following describes the selection of the weighting coefficients for signal combiners 206*a–d* for generating outputs (L', R', S' and C') when decoder 200 is operating in the surround-dominant operating mode (i.e. when decoder 200 has determined by phase detection that the surround output channel is selected to be the dominant channel).

The surround-dominant weighting coefficients are selected in accordance with the following criteria:

(1) each of the originally encoded input channels (L, R, S, and C) are to have equal power over the collective outputs (L', R', S' and C') when S' is dominant.

(2) the dominant output channel, S' is selected to have a 3 dB gain for the S component as compared to the other components; and (3) preferably, the weighting of the encoded components should be equal for each output with the exception of the dominant channel's output.

In accordance with the above-stated criteria the following values are preferred coefficients "a" and "b":

TABLE 2

| | a | b |
|---|---|---|
| L' | 0.577 | 0.577 |
| R' | 0.577 | 0.577 |
| C' | 0.577 | 0.577 |
| S' | 1.000 | −1.000 |

Selection of the above values for coefficients "a" and "b" results in the following set of equations for each output channel when decoder 200 is in the surround-dominant operating mode:

$$L'=0.577*L+0.577*R+0.816*C+0.000*S$$
$$R'=0.577*L+0.577*R+0.816*C+0.000*S$$
$$C'=0.577*L+0.577*R+0.816*C+0.000*S$$
$$S'=1.000*L-1.000*R+0.000*C+1.414*S.$$

LEFT-RIGHT OPERATING MODE

The following describes the selection of the weighting coefficients for signal combiners 206*a–d* for generating outputs (L', R', S' and C') when decoder 200 is operating in the left-right operating mode (i.e. when decoder 200 has determined by phase detection that the left (L) or right (R) components are dominant).

The left-right mode weighting coefficients are selected in accordance with the following criteria:

(1) each of the originally encoded input channels (L, R, S, and C) are to have equal power over the collective outputs (L', R', S' and C') when left-right mode is selected.

(2) components L and R in outputs L' and R' are each reproduced with unity gain; and (3) non-dominant encoded components are kept at equal levels. In accordance with the above-stated criteria the following values are selected for coefficients "a" and "b":

TABLE 2

| | a | b |
|---|---|---|
| L' | 1.000 | 0 |
| R' | 0 | 1.000 |
| C' | 0.707 | 0.707 |
| S' | 0.707 | −0.707 |

Selection of the above values for coefficients "a" and "b" results in the following set of equations for each output channel when decoder 200 is in the left-right operating mode:

$$L'=1.000*L+0.000*R+0.707*C+0.707*S;$$
$$R'=0.000*L+1.000*R+0.707*C-0.707*S;$$
$$C'=0.707*L+0.707*R+1.000*C+0.000*S;$$
$$S'=0.707*L-0.707*R+0.000*C+1.000*S.$$

Because the left-right operating mode is the default state (i.e. occurs in the absence of any steering) the above coefficients for "a" and "b" are implemented as non-steerable (fixed) weightings on signal combiners 206*a–d*. The left-right operating mode is implemented, for example, when the P and N control signals are at or near 0 Volts. Thus, if the control signals were to be selectively grounded using a switch or other selection device, the decoder 200 would remain in the left-right operating mode and would operate as a fixed matrix decoder.

To generate the other "steered" coefficients, a set of modification coefficients are created so that the sum of the left-right coefficients (the coefficients in the fixed state) and the modification coefficients generate either the set of coefficients for the center-dominant operating mode or the surround-dominant state operating mode.

The coefficients required to steer the matrix into the center-dominant mode are:

TABLE 4

| | a | b |
|---|---|---|
| L' | −0.423 | −0.577 |
| R' | −0.577 | −0.423 |
| C' | 0.293 | 0.293 |
| S' | −0.130 | 0.130 |

The coefficients required to steer the matrix into the surround-dominant mode are:

TABLE 5

| | a | b |
|---|---|---|
| L' | −0.423 | 0.577 |
| R' | 0.577 | −0.423 |
| C' | −0.130 | −0.130 |
| S' | 0.293 | −0.293 |

Collating the left-right (fixed) coefficients, the center modification coefficients and the surround modification coefficients for each signal combiner 206*a–d*, the following sets of coefficient tables are formed. These tables describe the weighting coefficients for each signal combiner 206*a–d*.

The weights for signal combiner 206*a* associated with the left output channel (L') are:

TABLE 6

| | |
|---|---|
| $L_T$ | 1.000 |
| $R_T$ | 0.000 |
| $L_T(P)$ | −0.423 |
| $R_T(P)$ | −0.577 |
| $L_T(N)$ | −0.423 |
| $R_T(N)$ | 0.577 |

The weights for signal combiner 206*b* associated with the center output channel (C') are:

TABLE 7

| | |
|---|---|
| $L_T$ | 0.707 |
| $R_T$ | 0.707 |
| $L_T(P)$ | 0.293 |
| $R_T(P)$ | 0.293 |
| $L_T(N)$ | −0.130 |
| $R_T(N)$ | −0.130 |

The weights for signal combiner 206*c* associated with the right output channel (R') are:

TABLE 8

| | |
|---|---|
| $L_T$ | 0.000 |
| $R_T$ | 1.000 |
| $L_T(P)$ | −0.577 |
| $R_T(P)$ | −0.423 |
| $L_T(N)$ | 0.577 |
| $R_T(N)$ | −0.423 |

The weights for signal combiner 206*d* associated with the surround output channel (S) are:

TABLE 9

| | |
|---|---|
| $L_T$ | 0.707 |
| $R_T$ | −.707 |
| $L_T(P)$ | −0.130 |
| $R_T(P)$ | 0.130 |
| $L_T(N)$ | 0.293 |
| $R_T(N)$ | −0.293 |

Thus, decoder 200 relies upon expanders 205*a–d* controlled by the P and N control signals to steer the encoded input signals $L_T$ and $R_T$, taking the matrix from one mode (state) to another. The above modification coefficients are implemented by summing the expanded (selectively attenuated) signals $L_T(P)$, $L_T(N)$, $R_T(P)$ and $R_T(N)$ along with the $L_T$ and $R_T$ audio signals using the coefficients as the polarity and weighting factors. A different sum is created for each of the outputs L', R', C', and S'.

The above coefficients were selected in accordance with the above-stated criteria. Other criteria for matrix coefficient select, on are used to achieve different audio effects. It should be understood that the principles of the present invention apply with matrices having coefficients selected using other methods.

VARIATIONS

While the description of decoder 200 shown herein is preferred, it is not the only embodiment of the techniques described. In another embodiment, the input channels $L_T$ and $R_T$ are filtered prior to phase detection so that the phase detector 203 indicates phase in a frequency range limited to the filter pass band range, such as the vocal range. Additionally, multiple filters and multiple phase detectors can be used, each with complimentary frequency ranges, to enable independent decoding of the complimentary frequency ranges.

In another version of the present invention, high pass filters at the inputs to the controller 204 reduce the sensitivity of the decoder to the hum and low frequency noise commonly found in audio systems. Such filtering also reduces undesirable steering that may take place with low frequency sound effects present in the input channels ($L_T$ and $R_T$). Low frequency information can also be filtered from $L_T$ and $R_T$ and then be optionally added back to L', C', R', and S' to minimize the sensitivity of decoder 200 to low frequencies.

For some applications it is useful to limit the frequency range of the expanded signals before they are combined by signal combiners 207*a–d*. This frequency limiting is useful for targeting the decoder operation to the vocal range, for instance, without requiring a crossover to split the frequency bands.

In one embodiment, the output of the multiplier 212 is selectively grounded using switch 210 to effectively turn off the steering control signals and place the decoder 200 into a passive fixed matrix state. The ability to operate in a fixed passive matrix state is useful for application requiring both active and passive matrix decoding.

Another embodiment is a three channel decoder with outputs L', R', and C'. For this decoder, the N control signal, and accompanying rectifier and expanders are not included in the decoder, and the weighting terms in the L', R', C' summers for $L_T(N)$ and $R_T(N)$ are set to 0.

Although only center and surround steering is implemented in this decoder, left and right steering could additionally be implemented. Left and right steering can also be implemented in a different embodiment and incorporated using the techniques described herein to steer audio using expanders and signal combiner (weighted summations). In such an embodiment, the controller 204 is used to detect center and surround information, while a log of ratios method is used to detect left and right dominance.

Thus, a matrix decoder system and method has been described that is based on a novel phase detection method. This method amplitude normalizes the input signals and thus the steering control signals are not affected by any imbalance in power as between the input channels. Thus, the present decoding system and method has improved stability and accuracy with a simplified steering mechanism which can be implemented using less circuitry and/or computational cycles than other techniques.

What is claimed is:

1. An apparatus for generating a plurality of directional signals from first and second input signals, comprising:

first and second decoder inputs adapted to receive first and second input signals;

a compressor coupled to the first and second decoder inputs and having first and second outputs, each output being an amplitude normalized signal corresponding to one of the first and second input signals;

a phase detecting controller coupled to the first and second outputs of the compressor for generating a plurality of control signals responsive to the phase difference between the amplitude normalized signals; and a matrix coupled to the first and second decoder inputs, and having a plurality of outputs each corresponding to a weighted combination of the first and second input signals responsive to the plurality of control signals.

2. The apparatus of claim 1 wherein the controller comprises:

a multiplier having first and second inputs coupled to the outputs of the compressor and having an output with an offset; and a phase decoder for generating said plurality of control signals responsive to the offset of the multiplier output.

3. The apparatus of claim 2 wherein the multiplier comprises a four quadrant multiplier having an output signal with an offset proportional to the relative phase difference between the signals received at first and second multiplier inputs.

4. The apparatus of claim 3 wherein the controller further comprises first and second filters coupling the controller inputs to the multiplier inputs for limiting phase detection to a frequency range.

5. The apparatus of claim 4 wherein the frequency range is substantially the vocal range.

6. The apparatus of claim 4 wherein the filters are high pass filters.

7. The apparatus of claim 2 wherein the phase decoder comprises:

a filter coupled to the phase decoder input;

a positive half-wave rectifier coupled to the filter for generating a first control signal; and a negative half-wave rectifier coupled to the filter for generating a second control signal.

8. The apparatus of claim 1 wherein the matrix comprises:

a bank of expanders coupled to the first and second decoder inputs and coupled to the phase detecting controller for attenuating the first and second input signals responsive to said control signals received from the phase detecting controller; and a bank of adders having multiplier weights associated with a plurality of adder inputs, coupled to the first and second decoder inputs and coupled to the outputs of the bank of expanders for generating a plurality of outputs by generating a weighted addition on a combination of any of the first decoder input, the second decoder input and selected expander outputs.

9. The apparatus of claim 1 further comprising a switch coupled to the phase detecting controller for selectively disabling the phase detecting controller to switch between a variable matrix and a fixed matrix mode.

10. A method of generating a plurality of output signals from first and second input signals, comprising:

adjusting the amplitudes of the first and second input signals to generate normalized first and second input signals;

detecting a phase difference between the normalized first and second input signals; and steering a variable matrix having a plurality of output signals each corresponding to a weighted summation of the first and second input signals, responsive to the detected phase difference.

11. The method of claim 10 further comprising the step of filtering the first and second input signals to isolate the detecting step to a frequency range.

12. The method of claim 11 wherein the frequency range is in a vocal frequency range.

13. The method of claim 10 wherein the step of detecting a phase difference between the normalized first and second input signals comprises the step of multiplying the normalized first and second input signals.

14. The method of claim 10 wherein the step of normalizing the first and second input signals comprises, the steps of:

detecting an effective value of each of the first and second input signals;

comparing each detected effective value to a threshold value;

attenuating the first input signal if the detected effective value of the first input signal exceeds the threshold value; and attenuating the second input signal if the detected effective value of the second input signal exceeds the threshold value.

* * * * *